United States Patent [19]

Burgess

[11] Patent Number: 4,575,880

[45] Date of Patent: Mar. 18, 1986

[54] AUTO-FLUSH SYSTEM

[75] Inventor: Robert H. Burgess, 6 McDonald Crescent, Strathfield, N.S.W., Australia, 2135

[73] Assignees: Robert Burgess; June Burgess, both of Strathfield, Australia

[21] Appl. No.: 575,563

[22] Filed: Jan. 31, 1984

[51] Int. Cl.[4] ..... E03D 1/14
[52] U.S. Cl. ..... 4/313; 4/302
[58] Field of Search ..... 4/313, 302, 300

[56] References Cited

FOREIGN PATENT DOCUMENTS 522747 5/1980 Australia .
13782 of 1895 United Kingdom ..... 4/313

*Primary Examiner*—Stephen Marcus
*Assistant Examiner*—Leo J. Peters
*Attorney, Agent, or Firm*—Holman & Stern

[57] ABSTRACT

An automatic flush cistern, and a device for actuating the flushing action of an automatic flush cistern whereby the cistern of a toilet or urinal is adapted to flush in response to the entry of a person into a predetermined area, such as the entry of a person through the entrance door of a public toilet, or at regular intervals during periods of infrequent use.

12 Claims, 5 Drawing Figures

1
2
3
4
5
6
7
8
11
13
14
15
16
20
21
22
23
24
25
27

AUTO-FLUSH SYSTEM

BACKGROUND OF THE INVENTION

1. Field of the Invention

The present invention relates to means for the automatic flushing of toilets, urinals, and the like, in response to traffic flow into the toilet area.

2. Description of the Prior Art

A known auto-flush cistern for use over urinals and the like, comprises a cistern having a syphon outlet at the bottom and fitted with a suspended intermediate tank or a tray-like vessel having a large float valve fitted to its floor. The tray accommodates the float of a ball-cock that admits water directly to the tray. Incoming water will fill the tray to a point where the ball-cock closes. The water level in the tray will then be above a small orifice through a wall of the tray which allows water to fall to the cistern proper immediately below at a constant rate, the inlet head to the orifice remaining essentially constant under the regulation of the admitting ball-cock. The rate of fill of the cistern is determined by the tray orifice size used. The water level in the cistern rises to a point just below the lip of the outlet syphon tube at which point the large float valve fitted to the floor of the tray lifts allowing the tray contents to fall rapidly into the cistern, starting the syphon which in turn rapidly drains the cistern to the urinal causing the tray float valve to close and the tray to refill rapidly via the wide open ball-cock. The cycle then repeats itself at say 5 minute intervals of whatever maximum rate that is determined by the tray orifice. The purpose of the above system is to reduce water wastage i.e. to set a limit on the frequency of flushes regardless of mains-pressure etc., even though the mains cock be wide open.

This known device fulfills all of the requirements of hygiene, i.e., by regular flushing, but is extremely wasteful of water if (a) the urinal has irregular or intermittent use over long periods, or (b) is not used at all say from normal closing hours to the commencement of activities the next morning.

In my earlier Australian Pat. No. 522,747 there is disclosed a device for actuating the flushing action of an automatic flush cistern, and also an automatic flush cistern incorporating such a device, whereby an automatic flush cistern is adapted to flush in response to the entry of a person into a predetermined area (e.g. the entry of a person through the entrance door of a public toilet).

By means of my earlier automatic flush cistern, it is possible to retain the auto-flush cistern's ability to limit the flushes to say one every 5 minutes in peak use periods, but also to provide the ability to flush only when the system is triggered by occupation of the urinal area. In other words, with heavy traffic the urinal will be flushed at a maximum of say 5 minute intervals, in medium traffic say one occupation every 30 minutes, it will flush once after occupation, and with no traffic it will not normally flush at all until traffic recommences.

However, in my earlier automatic flush cistern, problems sometimes arose in circumstances where there was only infrequent use of the device and the small float (10) tended to stick to its seat and not be dislodged by the pulse of air from the door closer or other means designed to initiate or activate the cycle, but instead the air pulse would blow the water from the tubular tailpipe extension with the result that subsequent air pulses would not have the necessary blocking water in the tail pipe extension to cause the small float to be dislodged.

By substituting for the earlier tubular tailpipe extension a cup shaped extension with upwardly extended peripheral walls, a much greater quantity of water is stored in this area and a more permanent source of blocking water is maintained so that a subsequent air pulse is capable of dislodging the small float from its seat.

A further drawback with my earlier automatic flush cistern resulted from the requirement or preference of some government or public health authorities for an automatic flush cistern being adapted to flush automatically, say, at least every hour, in order to contain and control any odors which might normally eminate from the toilet or urinal drains during lengthy periods of infrequent or non use. With my earlier automatic flush cistern, regular flushing was achieved by virtue of a small "vee" notch being placed in the valve seat of the draft tube of the auto-flush device which provided for a small leak of water to flow through the draft tube from the upper compartment to the lower compartment of the cistern, eventually resulting in a flush cycle being initiated.

However, this modification of my earlier auto-flush cistern was originally designed for automatic flushing every 6 to 12 hours. To increase the automatic flush frequency to at least once every hour, required increasing the size of the "vee" notch to allow for a greater volume of water to pass therethrough. This created problems where allowance had to be made for the different capacities of cisterns in use and because of differences in water supply pressure. The larger "vee" notch required invariably allows sufficient air to enter the draft tube at the beginning of the flush cycle to cause the valve to unseat as the upper tray or upper compartment of the cistern refills, thus initiating another flush cycle ad infinitum. This, of course, is undesirable and results in wastage of water.

BRIEF SUMMARY OF THE INVENTION

It is thus an object of the present invention to provide an auto-flush cistern, and an auto-flush device therefor, which retains the auto-flush cistern's ability to flush at regular intervals—say once every several minutes—during peak use periods, or to provide the ability to flush only when the system is triggered by occupation of the urinal area, but to also provide the ability to flush at regular intervals—say once every one hour or every few hours—during periods of infrequent or non use.

This and other objects of the invention will be apparent from the following description of various aspects and embodiments of the invention.

In one aspect the present invention provides means for actuating the flushing action of an automatic flush cistern, the automatic flush cistern comprising an upper water tank and a lower water tank and a ball-cock controlled water inlet to said upper water tank adapted to allow water to enter said upper tank to a predetermined level, said upper and lower water tanks being interconnected via a valve-operated orifice in a wall of said upper tank, wherein said valve opens in response to a predetermined water level in said lower water tank, said lower tank being in open communication with syphon means for emptying said lower tank when the predetermined water level in the lower tank is exceeded, said means for actuating the flushing action comprising tube means for extending through and providing communication between said upper and lower tanks, said tube means being adapted to remain filled with water when the lower tank has emptied, the upper end of said tube means being adapted to extend into said upper tank providing a valve seat, valve means associated with said valve seat slidably mounted about the said upper end of said tube means, the lower end of said tube means having cup means comprising a base and upwardly extending peripheral walls which surround but are spaced from the lower end of said tube and remotely-operated means for raising or unseating the said valve means whereby said valve means remains unseated until the upper tank empties into the lower tank.

Preferably, the said valve means is a float valve with a downwardly extending annular skirt slidably mounted about the end of the tube means. The annular skirt is provided radially with one or more orifices for communication with the open end of the tube means when the float valve is raised.

Further, the means for raising or unseating of the valve is preferably provided by a source of pulsed air or compressed air directed into the tube means at a point below said valve seat.

In another aspect the present invention provides an automatic flush cistern adapted to flush in response to the entry of a person into a predetermined area, said automatic flush cistern comprising an upper water compartment and a lower water compartment, both said compartments being in communication via a valve-operated orifice in a wall (preferably the bottom wall) of said upper compartment, wherein said valve opens in response to a predetermined water level in said lower compartment, syphon means extending through a wall (preferably the bottom wall) of said lower compartment for draining said lower compartment when said predetermined water level is exceeded, a ball-cock controlled water inlet to said upper compartment adapted to allow water to enter said upper compartment to a predetermined level, tube means extending through and providing communication between said upper and lower compartments with said tube means being adapted so as to remain filled with water when the lower compartment has emptied and with the upper end of said tube means extending into said upper compartment providing a valve seat, valve means associated with said valve seat slidably mounted about the said upper end of said tube means, the lower end of said tube means having cup means comprising a base and upwardly extending peripheral walls which surround but are spaced from the lower end of said tube and remotely-operated means for raising or unseating said valve means whereby said valve means remains unseated until the upper compartment empties into the lower compartment.

BRIEF DESCRIPTION OF THE DRAWINGS

The invention will now be further described with reference to a preferred embodiment as illustrated in the drawings, relating to the modification of a known auto-flush cistern wherein.

DETAILED DESCRIPTION

Figures 1, 2:
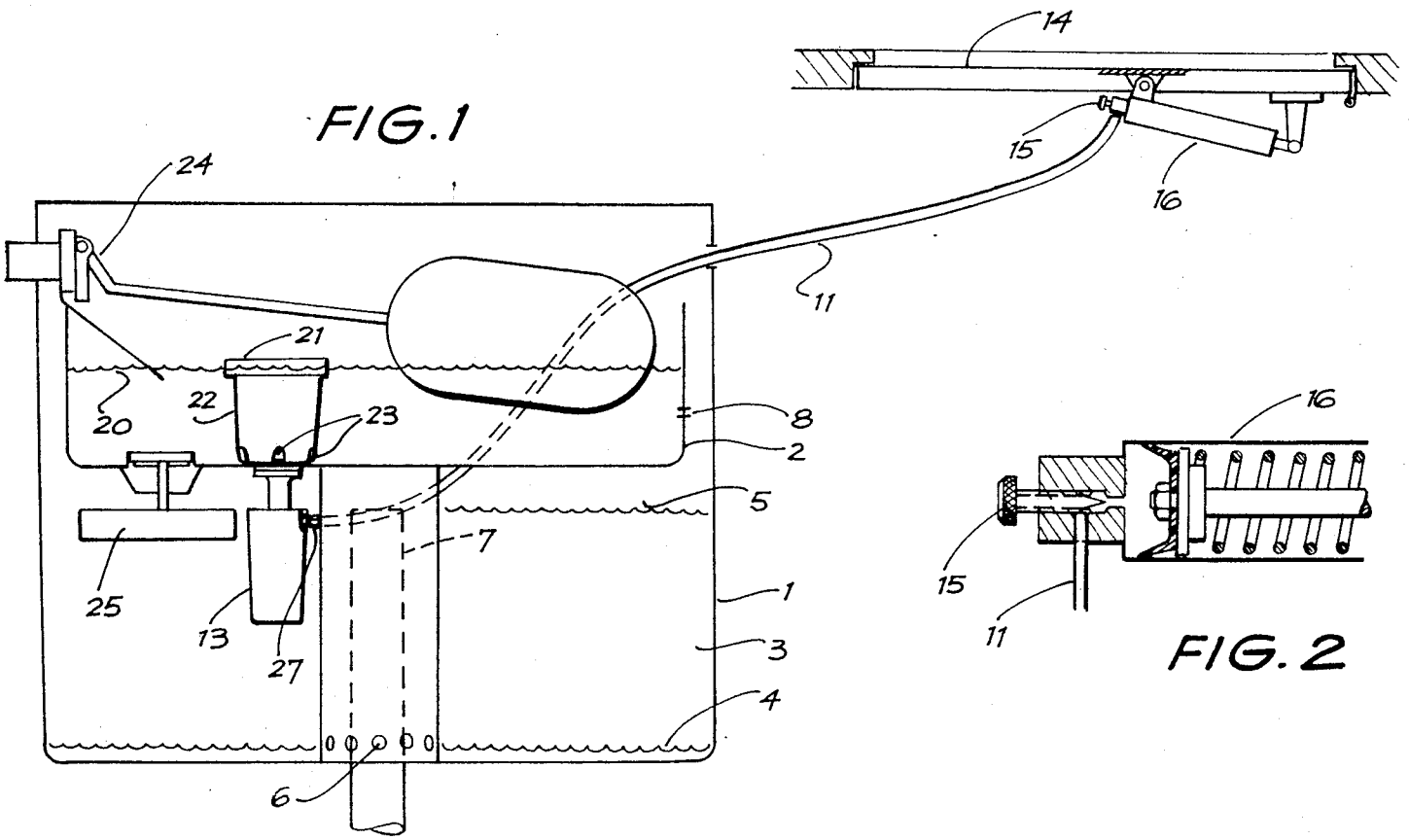
FIG. 1 is a schematic side elevation view of a modified auto-flush cistern according to the present invention.
FIG. 2 is an enlarged cross sectional view of part of the pneumatic door closer illustrated in FIG. 1.

The auto-flush cistern 1 comprises an upper water tray or compartment 2 and a lower water compartment 3, having minimum and maximum water levels 4 and 5, respectively, determined by the entry port 6 to, and the height of, the main syphon tube outlet 7.

Figure 3:
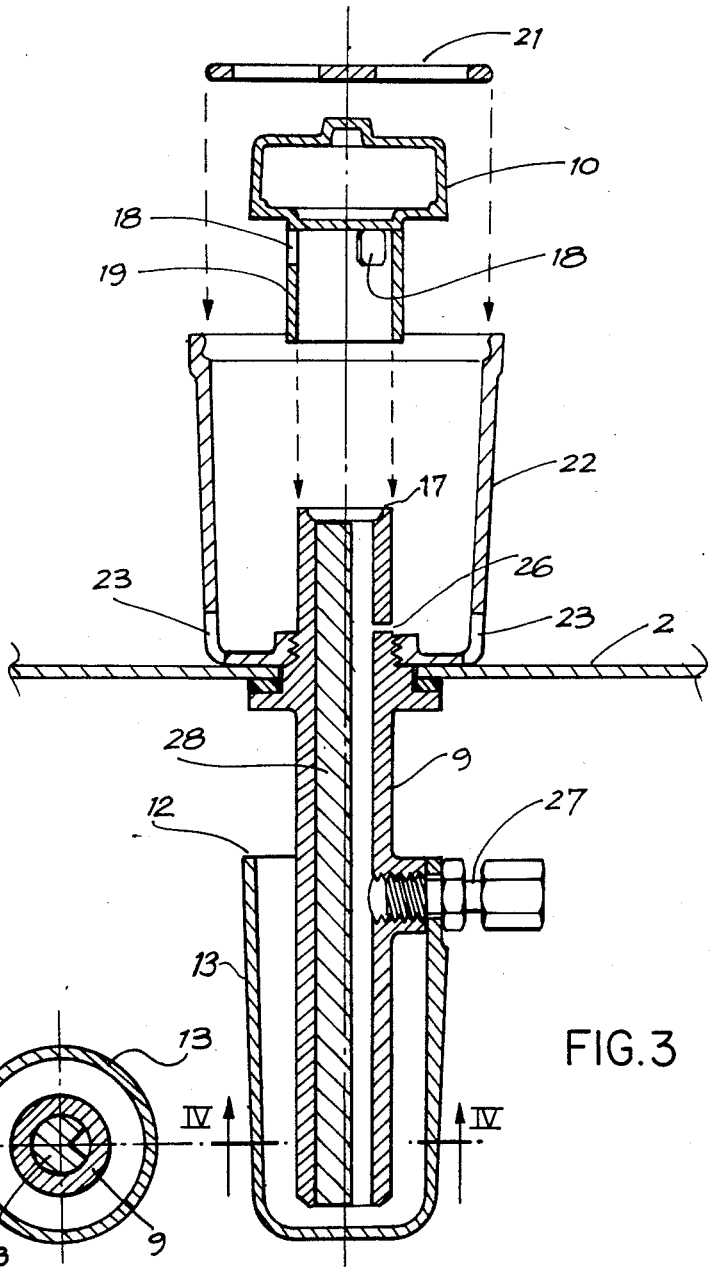
FIG. 3 is an enlarged, partly exploded vertical cross sectional view of the flush regulating mechanism used in the modified auto-flush cistern illustrated in FIG. 1.
Figure 4:
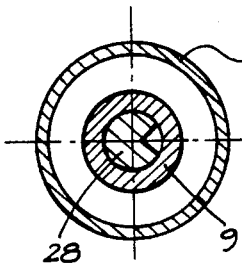
FIG. 4 is a cross-sectional view taken along line IV—IV of FIG. 3.
Figure 5:
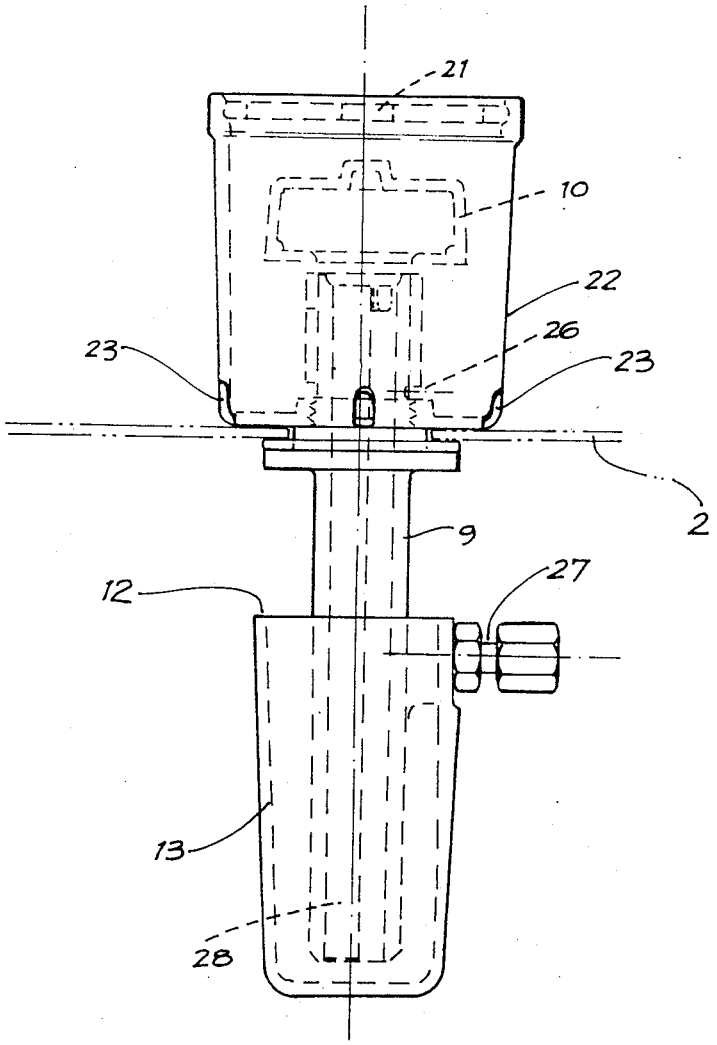
FIG. 5 is a side elevation view of the flush regulating mechanism illustrated in FIG. 3, with the float assembly seated in position on the valve seat of the draft tube.

The existing tray orifice 8 (if present) is plugged and a draft tube 9 and small float assembly 10 is fitted through the floor of the tray 2 as shown in FIGS. 1 and 3. The flush regulating mechanism is shown in more detail in FIG. 3. A small bore signal tube 11, e.g. 3.1 mm O.D.×2.7 mm I.D. nylon tube, is lead from a connection point 27 on the draft tube substantially level with the upper edge 12 of the lower cup 13 any distance to the entrance door 14 leading to the urinal. The signal tube is here connected to the space above the seat of the closing speed regulator screw 15 of a standard spring-pneumatic type door closer 16.

Normally, the vertical distance from the top of the draft tube 9 to the upper edge 12 of the cup 13 is less than the vertical distance from the upper edge 12 to the bottom of the draft tube.

The draft tube bore is gauged to allow the required rate of flow from the tray to the system in a similar fashion to the function of the tray orifice in the existing device. In one embodiment (see FIG. 3), variation in the bore of the draft tube is achieved by use of a "vee"-notched insert member 28.

The upper end of the draft tube is formed as a valve seat 17 and terminates at a similar height above the tray floor 2 as does the original orifice 8. The small float valve 10 is guided around the protruding upper part of the draft tube and has ports 18 in the upper part of the guiding skirt 19 to allow easy entry of water when the valve is open. The small float surmounting the valve has bouyancy such as to not raise the valve off its seat when the draft tube and the tailpipe are full of water and the tray is filled to ball-cock cutoff water level 20 e.g., the end of cycle condition. The small float 10 must however have sufficient bouyancy to float rapidly upwards and rest against the spider 21 or other stop means if the valve is momentarily lifted off its seat.

The upper cup or baffle cylinder 22 protects the small float 10 from wave disturbance from incoming ball-cock flow and has ample flow holes 23 in its lee lower side.

In practice, the automatic flush system operates as follows:

Beginning with a dry system, and with the small float valve 10 closed, the incoming water fills the tray 2 from the ball-cock operated means 24 and lifts the small float valve 10 in doing so. Water flows from the tray 2 to the lower water compartment 3 of the cistern at the rate determined by the bore of the draft tube 9. The cistern fills to near syphon point, at which stage the large float valve 25 lifts and the tray empties. This causes the small float valve to close, thus trapping the draft tube full of water. As a result of syphon action the cistern 3 flushes, thus causing the large float valve 25 to close. The tray 2 refills with water from the open ball-cock 24 but the small float valve 10 remains closed due to the weight of water in the draft tube 9. With the tray filled to a predetermined level, the ball-cock closes and the system comes to rest (idle condition) and awaits a signal to commence the flushing cycle.

When the toilet door 14 is opened and closed, the flush-cycle commences. A small pulse of air arrives from the door-closer 16 through the signal tube 11 to the draft tube, which dislodges the small float valve 10 allowing it to float upwards, thus allowing the flow of water from the tray 2 to the lower water compartment 3 of the cistern, sweeping any air before it. The ball-cock 24 then opens to maintain the level 20 in the tray. Water continues to flow into the cistern via the draft tube lower cup 13 until it reaches a predetermined level, at which point the large float valve 25 lifts and the tray 2 empties into the lower water compartment 3. This causes the small float valve to close, trapping the draft tube 9 full of water. The rapid filling of the cistern causes the cistern to flush as a result of syphon action, followed by the closure of the large float valve. The tray refills with water from the open ball-cock; the small float valve remains closed due to weight of the water in the draft tube. The tray fills with water to a predetermined level 20 at which point the ball-cock closes and the system again comes to rest (idle position) and awaits a further signal from the door-closer. Should the valve 10 be retained in the unseated condition (i.e., the valve remains open) the system would revert to a constant recycling fluch of the prior art type and continue flushing at regular intervals, e.g. every 5 minutes.

Once the flush-cycle has been triggered, any later signal will have no effect, the air pulse being merely swept to the cistern. The system can normally only be triggered when it is in its idle waiting condition.

Various alternatives are envisaged for the door-closer providing the necessary signal to commence the flush cycle. For example pressure applied to the step of the toilet or urinal could be adapted to provide a pulse of air or some other alternate signal. The system could be made operative by means of a suitable solenoid and diaphragm acting in response to an appropriate signal or, for example, by electrical or mechanical means to unseat the valve.

A very slow water leak in the system would ultimately end in a flush followed by the system reverting to the idle condition. In fact, in some embodiments of the invention, it is preferable to incorporate a small notch in the draft tube valve seat 17, so that a leak is caused, purposely, from the tray 2 to the lower compartment 3 of the auto-flush cistern 1. This ensures that a flush will occur, for example once every 6 to 12 hours.

Preferably, to ensure flushing of the system at regular intervals, say, once every hour, to keep the urinal and drains fresh during periods of infrequent or non use of the toilet area, it is necessary to incorporate more reliable means into the system to ensure a slow leak of water into the system. This can be achieved by introducing a small diameter hole 26 (FIG. 3) through the sidewall of the draft tube 9 into the main metering passage thereof. The hole 26 is preferably situated at the lower part of the upper end of the draft tube 9, such that the hole 26 remains covered with water even when the upper tray 2 empties the main part of its water into the lower compartment 3 of the cistern. There is always some water in the bottom of the tray 2 due to incoming water flow from the ball-cock 24; even in cases where the mains water pressure is low, the hole 26 remains covered with water thus preventing the ingress of air.

The bore size of the hole 26 will vary depending upon factors including the capacity of the cistern and the time at which these long period flushes are required. The base size of the hole will be determined by the leakage rate required. For example, hole sizes of about 0.030–0.043 inches have been found to be suitable. The hole, although small does not normally tend to block due to the self-cleaning action produced by the pulse of air that initiates a flush cycle. A rapid flow upward through the hole thus tends to clear any foreign material from the hole.

The automatic flushing cistern of the present invention can be manufactured from any suitable materials, such as plastics or metal. The component parts of the auto-flush device, except for the metal connection 27 and the rubber washer shown in FIG. 3 are made from any suitable plastics material, usually by injection moulding. The parts are joined together by means of suitable screw thread fittings on mating parts, or by friction fitting or by the use of solvents or adhesives where appropriate.

Although the invention has been described above with reference to preferred embodiments and drawings, it will be appreciated that numerous variations, modifications or alternatives may be substituted for specifically described features, without departing from the spirit or scope of the invention as broadly described.

I claim:

1. In a device for actuating the flushing action of an automatic flush cistern, the cistern having an upper water tank and a lower water tank, a ball-cock controlled water inlet to the upper water tank adapted to fill the upper tank to a predetermined level, a valve-operated orifice in a wall of the upper tank interconecting the tanks, the valve being adapted to open the orifice in response to a predetermined water level in the lower tank, and a syphon device in open communication with the lower tank for emptying the lower tank when the predetermined water level in the lower tank is exceeded, the improvement in the actuating device comprising:

tube means extending through a wall of the upper tank having upper and lower ends extending into said upper and lower tanks, respectively, providing communication between said tanks and being adapted to remain filled with water when said lower tank is emptied;

a small bore hole through a sidewall of the upper end portion of said tube means;

a valve seat on said upper end of said tube means;

valve means operatively associated with said valve seat movably mounted around said upper end of said tube means;

a cup shaped member adjacent said lower end of said tube means comprising a base and an upwardly extending peripheral wall portion in surrounding spaced relationship with respect to a lower end portion of said tube means; and remotely operated means operatively associated with said tube means for raising and unseating said valve means from said valve seat so that said valve means remains unseated until the water in said upper tank empties into said lower tank.

2. A device as claimed in claim 1 wherein:

said upper tank has a base;

said wall of said upper tank through which said tube means extends comprises said base; and said small bore hole is situated adjacent to and above said base.

3. A device as claimed in claim 1 wherein said means for raising and unseating said valve means comprises means to provide a pulse directed into said tube means at a point below said valve seat.

4. A device as claimed in claim 3, wherein said means to provide a pulse comprises an automatic door closer operatively connected to said tube means to produce a pulse of air.

5. A device as claimed in claim 1, wherein said valve means comprises a float valve having a downwardly extending annular skirt extending around an upper end portion of said tube means and at least one radially extending orifice through said skirt for communication with the open upper end of the tube means when said float valve is raised.

6. A device as claimed in claim 5, wherein said means for raising and unseating said valve means comprises means to provide a pulse of air directed into said tube means at a point below said valve seat.

7. An automatic flush cistern adapted to flush in response to the entry of a person into a predetermined area comprising:

an upper water compartment;

a lower water compartment positioned below said upper water compartment;

a ball-cock controlled water inlet to said upper compartment adapted to fill said upper compartment to a predetermined level;

a valve-operated orifice in a wall of said upper compartment interconnecting said compartments, said valve being adapted to open said orifice in response to a predetermined water level in said lower compartment;

a syphon device in open communication with said lower compartment for emptying said lower compartment when said predetermined water level in said lower compartment is exceeded;

tube means extending through a wall of said upper compartment having upper and lower ends extending into said upper and lower compartments, respectively, providing communication between said compartments and being adapted to remain filled with water when said lower compartment is emptied;

a small bore hole through a sidewall of the upper end portion of said tube means;

a valve seat on said upper end of said tube means;

valve means operatively associated with said valve seat mounted around said upper end of said tube means;

a cup shaped member adjacent said lower end of said tube means comprising a base and an upwardly extending peripheral wall portion in surrounding spaced relationship with respect to a lower portion of said tube means; and remotely operated means operatively associated with said tube means for raising and unseating said valve means from said valve seat so that said valve means remains unseated until the water in said upper compartment empties into said lower compartment.

8. An automatic flush cistern as claimed in claim 7, wherein said valve means comprises a float valve having a downwardly extending annular skirt extending around an upper end portion of said tube means and at least one radially extending orifice through said skirt for communication with the open upper end of the tube means when said float valve is raised.

9. An automatic flush cistern as claimed in claim 8, wherein said means for raising and unseating said valve means comprises means to provide a pulse of air directed into said tube means at a point below said valve seat.

10. An automatic flush cistern as claimed in claim 7, wherein said means for raising and unseating said valve means comprises means to provide a pulse directed into said tube means at a point below said valve seat.

11. An automatic flush cistern as claimed in claim 10, wherein said means to provide a pulse comprises an automatic door closer operatively connected to said tube means to produce a pulse of air.

12. A device as claimed in claim 7 wherein:

said upper tank has a base;

said wall of said upper tank through which said tube means extends comprises said base; and said small bore hole is situated adjacent to and above said base.

* * * * *